US006505012B2

(12) United States Patent
Maebashi et al.

(10) Patent No.: US 6,505,012 B2
(45) Date of Patent: Jan. 7, 2003

(54) IMAGE FORMING APPARATUS

(75) Inventors: Yoichiro Maebashi, Shizuoka (JP); Tomoaki Nakai, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/940,493

(22) Filed: Aug. 29, 2001

(65) Prior Publication Data

US 2002/0028084 A1 Mar. 7, 2002

(30) Foreign Application Priority Data

Aug. 30, 2000 (JP) ..... 2000-261657

(51) Int. Cl.[7] ..... G03G 15/00

(52) U.S. Cl. ..... 399/49; 399/55

(58) Field of Search ..... 399/49, 46, 60, 399/59, 55

(56) References Cited

U.S. PATENT DOCUMENTS 5,826,136 A * 10/1998 Saiko et al. ..... 399/49
6,118,953 A * 9/2000 Hockey et al. ..... 399/59

OTHER PUBLICATIONS

U.S. Patent Application No. 09/940,641, filed Aug. 29, 2001 (GAU 2852).

* cited by examiner

*Primary Examiner*—Joan Pendegrass
(74) *Attorney, Agent, or Firm*—Fitzpatrick, Cella, Harper & Scinto

(57) ABSTRACT

An image forming apparatus is capable of continuously forming images with proper density without reducing the image forming speed and, retrains toner consumption. A CPU for calculating an image forming condition by a density sensor is provided. The image forming operation is conducted in basis of a calculated new image forming condition and a current image forming condition used prior to the calculation of a new image forming condition in the image forming operation so as to determine an available image forming condition.

18 Claims, 13 Drawing Sheets

IMAGE FORMING APPARATUS

BACKGROUND OF THE INVENTION

1. Field of the Invention

The present invention relates to an image forming apparatus for forming images on recording materials such as sheet materials.

2. Description of the Related Art

A conventional image forming apparatus will be described with reference to FIG. 8, which is a sectional view of a conventional color image forming apparatus.

Referring to the drawing, a photosensitive drum 1 serving as an image bearing member is driven in the direction indicated by the arrow by a driving means (not shown); it is charged uniformly by a primary charger 2.

Then, a laser beam L which is in conformity with an yellow image is applied to the photosensitive drum 1 from an exposure device 3, whereby a latent image is formed on the photosensitive drum 1.

As the photosensitive drum 1 further rotates in the direction of the arrow, a developing device 4*a,* containing yellow toner, of four developing devices 4*a* (yellow), 4*b* (magenta), 4*c* (cyan), and 4*d* (black) supported by a rotation supporting means 11 rotates to come to be opposed to the photosensitive drum 1, and the image is visualized by the yellow developing device 4*a* selected.

An intermediate transfer belt 5 rotates in the direction of the arrow substantially at the same speed as the photosensitive drum. The toner image formed and borne on the photosensitive drum 1 undergoes primary transfer to the outer surface of the intermediate transfer belt 5 by a primary transfer bias applied to a primary transfer roller 8*a.*

The above-described process is performed for the four colors: yellow (hereinafter referred to as Y), magenta (hereinafter referred to as M), cyan (hereinafter referred to as C), and black (hereinafter referred to as K), whereby a toner image of a plurality of colors is formed on the intermediate transfer belt 5.

Next, a transfer material is fed with a predetermined timing from a transfer material cassette 12 by means of pick-up rollers 13.

At the same time, a secondary transfer bias is applied to a secondary transfer roller 8*b,* and the toner image is transferred from the intermediate transfer belt 5 to the transfer material.

Further, the transfer material is conveyed by a conveyance belt 14 to a fixing device 6, where fusion and fixing are effected, whereby a color image is obtained.

The toner remaining on the intermediate transfer belt 5 is removed by an intermediate transfer belt cleaner 15.

On the other hand, the toner remaining on the photosensitive drum 1 is removed by a cleaning device 7 consisting of a well-known blade means.

When using the image forming apparatus described above, maintenance operations, such as toner replenishment, the disposal of waste toner, and the replacement of the photosensitive drum 1 when it has been worn.

In this example, the photosensitive drum 1, the primary charger 2, and the cleaning device 7 are integrated into a process cartridge A, and the developing devices 4*a,* 4*b,* 4*c,* and 4*d* are also in the form of a developing cartridge which is easily detachable with respect to the apparatus main body, so that the maintenance operations can be easily conducted by the user.

Generally speaking, in an electrophotographic image forming apparatus, fluctuations in the density characteristics of the printed image are caused by the fluctuations in characteristics due to the use environment, the developing device, the number of sheets on which printing has been effected by the photosensitive drum, the variation in sensitivity generated at the time of the production of the photosensitive drum, the variation in frictional charging characteristics generated at the time of the manufacturing of the toner, etc.

Although strenuous efforts have been put into stabilizing the characteristics in the variations and fluctuations, no satisfactory result has been achieved yet.

In particular, in a color image forming apparatus, it is necessary to adjust the conditions for the image formation in the four colors of Y, M, C, and K before the user can achieve a desired density and color balance.

In view of this, in the color image forming apparatus of this example, a plurality of toner images for detection are formed on the photosensitive drum 1 by varying the image forming condition stepwise, and the reflection light quantity thereof is measured by a density sensor 9. On the basis of the result of the measurement, an image forming condition which is likely to provide a desired density (reflection light quantity) is computed by a CPU 17 of the main body for image density control.

Thus, the CPU 17 and the density sensor 9 correspond to image formation condition computing means constituting elements of the present invention used in the embodiment described below.

Next, the density sensor 9 will be described with reference to FIG. 9, which is a schematic view of the density sensor applied to the image forming apparatus shown in FIG. 8.

The density sensor 9 is composed of a light emitting element 91 such as LED, a photoreceptor 92 such as a photo diode, and a holder 93. Infrared radiation from the light emitting element 91 is applied to a patch P on the photosensitive drum, and the reflected light therefrom is measured by the photoreceptor 92, whereby the density of the patch P is measured.

The reflected light from the patch P contains a regular reflection component and an irregular reflection component. The light quantity of the regular reflection component undergoes great fluctuations depending on the condition of the photosensitive drum surface underneath the patch and fluctuation in the distance between the sensor and the patch. Thus, when the reflected light from the patch to be measured contains a regular reflection component, the detection accuracy deteriorates to a marked degree.

In view of this, in the density sensor 9, in order that no regular reflection component from the patch P may impinge on the photoreceptor 92, the angle at which light is applied to the patch P is set to 45° and the reception angle of the reflected light from the patch P is set to 0° with respect to the normal I, thus measuring only the irregular reflection component.

Next, the image density control in the color image forming apparatus of this example will be described in detail.

First, the photosensitive drum 1 is charged by the primary charger 2 such that its surface potential becomes −600V.

The sensitivity of the photosensitive drum and the exposure amount of the laser are adjusted beforehand such that the potential of the laser exposure portion at normal temperature and normal humidity (23° C., 60% Rh) is approximately −200V.

The developing bias is obtained by superimposing a rectangular wave (with a frequency of 2000 Hz, 1800 Vpp) on a DC voltage, as shown in FIG. 10. By making the DC voltage component Vdc variable, the toner development amount is controlled. FIG. 10 is a graph depicting the developing bias applied to the image forming apparatus shown in FIG. 8.

Further, prior to normal image formation, a plurality of toner image patches of 30 mm square are printed at intervals, as shown in FIG. 11, on the portion of the drum corresponding to the density sensor 9. FIG. 11 is a schematic diagram showing patches for density detection applied to the image forming apparatus shown in FIG. 8.

The image patches are each developed by developing biases with different DC voltage components, and reflection light quantity measurement is performed on each of them by the density sensor 9. In this example, the number of image patches is five, the DC component Vdc of the developing bias being varied from −300V to −500V in steps of 50V.

FIG. 12 shows an example of the result of reflection density measurement. FIG. 12 is a graph showing the relationship between reflection density and developing bias in the image forming apparatus shown in FIG. 8.

In this example, the target value of the reflection density of the toner (proper density value) is 1.4, and control is effected such that image formation is conducted under a developing condition estimated to be closest thereto (in this example, the DC voltage component of the developing bias).

In this example, reflection density data as indicated by the five points in FIG. 12 was obtained. The developing condition providing the reflection density of 1.4 lies in the section where the DC component Vdc is between −400V and −450V. Assuming that DC component is approximately proportional to reflection density in this section, it is to be assumed, through Interior division of the section between −400V and −450V, that the reflection density is 1.4 when the DC component is approximately −420V.

Thus, in this example, the DC component Vdc of the developing bias as an image formation condition is controlled to be −420V.

The above-described control is executed for each of the colors, Y, M, C, and K, whereby the image density control is completed.

The image density control is executed prior to image formation (printing) each time printing is performed on a predetermined number of sheets, when the power source of the main body is ON, when replacing the process cartridge A or the development cartridges (developing devices) 4*a*, 4*b*, 4*c*, and 4*d*, and when a printing command is received when the apparatus has not been in use for a long period of time.

While in this example the number of image patches is five, it is also possible to increase the number to vary the developing bias in more steps, thereby performing control more accurately.

When the variation in image density is too great to be coped with solely by adjusting the developing bias, it is also possible to perform control by combining other image formation conditions, such as charging condition and exposure condition (exposure amount).

The conventional color image forming apparatus, however, has the following problems.

As described above, in an electrophotographic image forming apparatus, the developing characteristics of the developing device and the photosensitive characteristics of the photosensitive drum fluctuate according to the condition of use of the apparatus, with the result that the image density varies.

In particular, when printing is conducted successively, the above-mentioned fluctuations in characteristics are more conspicuous, and the image density is greatly varied.

Thus, each time printing is performed on a fixed number of sheets, the above-described image density control is executed, whereby the image density is prevented from being too much deviated from the proper value.

However, even if such control is performed, fluctuation in density naturally occurs between image density control operations.

And, when the fluctuation in density occurs to a large degree, a marked difference in density is generated before and after the execution of the image density control.

This will be explained in detail with reference to FIG. 13, which is a graph showing the variation in image density when printing is successively executed in a conventional image forming apparatus.

In the drawing, the vertical axis indicates density, and the horizontal axis indicates the number of sheets on which printing is performed. Broken line A indicates the proper image density for the apparatus, and broken line B indicates how the image density will change when image density control is not conducted each time printing has been conducted on a fixed number of sheets.

At the left-hand end (x0) of the graph, image density control is effected, and the image density is adjusted to the proper density.

As can be seen from the graph, if density control is not executed each time printing has been performed on a fixed number of sheets, the image density will continue to increase to be greatly deviated from the proper density.

Thus, it is necessary to conduct image density control each time printing has been performed on a fixed number of sheets. Solid line C indicates how the image density changes when image density control is performed.

In this example, image density control is effected each time printing has been performed on 100 sheets. Density control is effected at points in time indicated by numerals X1 and X2 in the drawing.

By thus performing image density control, the image density is prevented from being greatly deviated from the proper density for a long period of time.

However, there occurs a marked fluctuation in density between the execution of image density control (indicated by X1 and X2 in the drawing).

Suppose the user successively conducts the printing of the same image before and after density control. For example, if printing is successively performed on twenty sheets, for example, from the 90th to 110th sheet, there is the possibility of the image density of the first ten sheets being greatly different from that of the ten sheets after density control.

In particular, in the case of a color image forming apparatus like that of this example, in which a full color image is reproduced by superimposing four color toner images one upon the other, a great variation in the density of a particular color (one of Y, M, C, and K) results in a marked change in the hue of the image which is very conspicuous.

FIG. 14 shows an example in which, conversely to the case of FIG. 13, image density is gradually reduced. As can be seen from this graph, a similar problem is involved also in this case. FIG. 14 is a graph showing the variation in image density when printing is successively executed in a conventional image forming apparatus.

The above problem might be coped with by frequently performing image density control. In that case, however, the requisite time for density control would cause a reduction in the printing speed. Moreover, that would involve the consumption of a lot of toner for density control.

SUMMARY OF THE INVENTION

It is an object of the present invention to provide an image forming apparatus which is capable of preventing an abrupt fluctuation in image density.

Another object of the present invention is to provide an image forming apparatus in which the difference in image density between an initial stage of use and a stage after long use is reduced.

Still another object of the present invention is to provide an image forming apparatus in which a reduction in image forming speed when changing an image formation condition is mitigated.

A further object of the present invention is to provide an image forming apparatus in which toner consumption for changing an image formation condition is restrained.

A further object of the present invention is to provide an image forming apparatus in which it is possible to change an image formation condition gradually and stepwise.

These and still other objects, advantages and benefits may be achieved using an image forming apparatus comprising:

an image forming means for forming an image on a recording material;

a detecting means for detecting an image density; and a changing means for changing a former image formation condition for the image forming means to a next image formation condition for the image forming means on the basis of a detection result of the detecting means, wherein the changing means is capable of changing the former image formation condition so as to bring it close to the next image formation condition through a stepwise change of image formation condition.

Further objects and features of the present invention will become more apparent from the following detailed description with reference to the accompanying drawings.

DETAILED DESCRIPTION OF THE PREFERRED EMBODIMENTS

Figure 1:
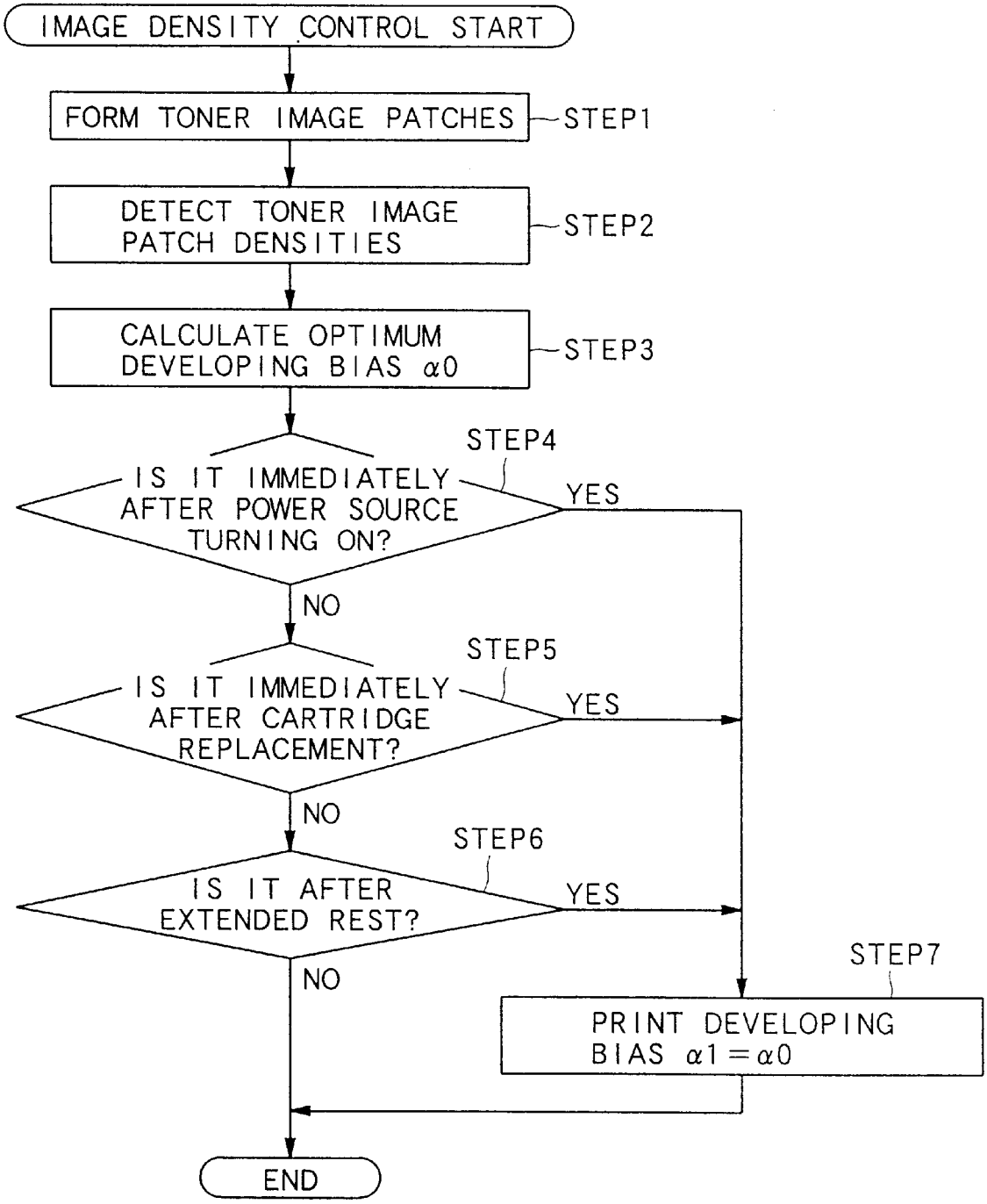
FIG. 1 is a flowchart showing an image forming operation applicable to a first embodiment of the image forming apparatus of the present invention.

Preferred embodiments of this invention will now be described in detail with reference to the drawings. It is to be noted that the dimensions, materials, configurations, positional relationships, etc. of the components described below should not be construed restrictively unless otherwise specified.

Further, the components which are similar to those of the prior art described above and those which are used in the above-mentioned figures are indicated by the same reference numerals. Further, it should be noted that the following description of the embodiments of the image forming apparatus of the present invention also serves as the description of the embodiments of the image forming method of the present invention.

(First Embodiment)

First, a first embodiment of the image forming apparatus of the present invention will be described. In the image forming apparatus of this embodiment, a gradual increase or decrease in image formation condition is effected, from a first image formation condition selected immediately before the execution of image density control toward a second image formation condition calculated through image density control, whereby an abrupt variation in density is prevented.

The main construction of the color image forming apparatus used in this embodiment is the same as that of the conventional color image forming apparatus described with reference to FIG. 8, so that a detailed description thereof will be omitted, and the components shown in FIG. 8 will be referred to as appropriate.

In this embodiment, the DC component of a developing bias, which constitutes a developing condition, is used as the image formation condition to be changed so as to control image density.

First, with reference to the flowchart of FIG. 1, the image density control of this embodiment will be described in detail. FIG. 1 is a flowchart showing an image forming operation applicable to the first embodiment of the image forming apparatus of the present invention.

First, when an execution command for image density control is input to the CPU 17 of the main body, an image density control sequence is started.

In this embodiment, image density control is executed in any one of the following conditions.

1. When the apparatus main body power source s ON (the period between the turning ON of the power source and the completion of preparation for image formation).
2. When the process cartridge A or the developing cartridges (developing devices) 4*a,* 4*b,* 4*c,* and 4*d* are replaced.
3. When a printing command is received when the apparatus has not been used for a long period of time (one hour in this embodiment; this period can naturally be changed arbitrarily, which also applies to the following embodiments).
4. When printing has been performed on a predetermined number of sheets (100 sheets in this embodiment; the number can naturally be changed arbitrarily, which also applies to the following embodiments).

Step 1

First, toner images for detection (toner patches) are formed on the photosensitive drum 1. For each of the colors Y, M, C, and K, five toner patches are formed, varying the DC component Vdc of the developing bias from −300V to −500V in steps of 50V.

Step 2

The densities of the toner patches formed in STEP 1 are measured by the density sensor 9.

Step 3

From the results of the measurement of the toner patch densities, the CPU 17, for example, calculates an optimum DC voltage (optimum developing bias) á0.

Here, the value of the optimum developing bias á0 is a value at which the toner patch density is 1.4, which is the proper density for this image forming apparatus.

The optimum developing bias value á0 obtained is stored in a memory (not shown) in the main body.

The main body memory may be volatile or nonvolatile. In this embodiment, a volatile memory is used.

Step 4

A judgment is made as to whether image density control is to be executed when the main body power source is ON. Immediately after the turning ON of the power source, the voltage used by the apparatus before the turning ON of the power source is unknown, so that the value of the optimum developing bias á0 calculated immediately after the control is used.

In the color image forming apparatus of this embodiment, a print developing bias á1 is prepared as the developing bias value to be used at the time of printing, separately from the optimum developing bias value á0, and is stored in the main body memory.

Thus, when it is determined that the image density control is that which is executed immediately after the turning ON of the main body power source, the procedure advances to STEP 7, and the optimum developing bias á0 obtained through image density control is input to the print developing bias value á1.

Step 5 and Step 6

A judgment is made as to whether the image density control is that which is executed immediately after the replacement of the cartridge (the process cartridge A or the developing cartridge) (STEP 5).

Similarly, a judgment is made as to whether the image density control is that which is executed when a printing command is received when the apparatus has not been used for a long period of time (which is one hour in this embodiment) (STEP 6).

In either case, it is desirable to use the value of the optimum developing bias value á0 calculated immediately after density control, so that the procedure advances to STEP 7, where the optimum developing bias á0 obtained through image density control is input to the print developing bias value á1.

When none of the conditions of STEP 4, STEP 5, and STEP 6 is applicable, the control is completed without updating the print developing bias value á1.

In this case, the image density control executed is that which is conducted when printing has been performed on a predetermined number of sheets (100 sheets in this embodiment).

Thus, the print developing bias value á1 stored in the main body memory is the developing bias value used immediately before the image density control.

The above image density control is performed on each of the colors Y, M, C, and K, and the image density control is completed.

It goes without saying that the optimum developing bias value á0 and the print developing bias value al are provided independently for each of the colors (Y, M, C, and K), and stored in the main body memory for the respective colors.

Figure 2:
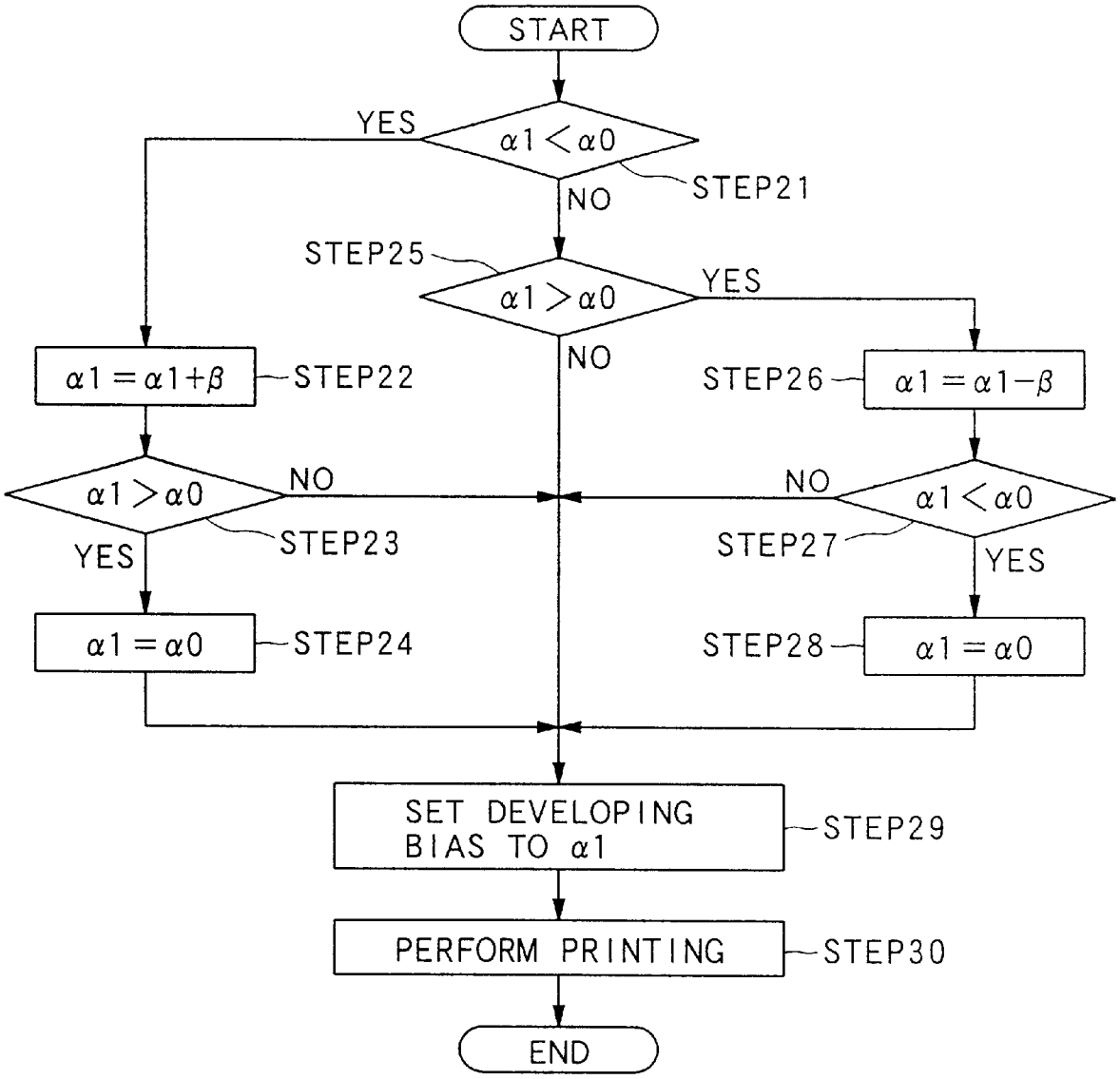
FIG. 2 is a flowchart showing an image forming operation applicable to the first embodiment of the image forming apparatus of the present invention.

Next, the developing bias control at the time of printing will be described with reference to the flowchart of FIG. 2. FIG. 2 is a flowchart illustrating an image forming operation applicable to the first embodiment of the image forming apparatus of the present invention.

The developing bias calculation at the time of printing is conducted for each print sheet. That is, each time printing is performed, the operation of the flowchart is started and executed.

Step 21

First, the developing bias value á1 used in the previous printing is compared with the developing bias value á0 calculated through image density control. When á0 is larger than á1, the procedure advances to STEP 22.

Step 22

In STEP 22, a developing bias adjustment value â is added to the developing bias value á1 used in the previous printing (the value corresponding to the image formation condition before changing) to update the print developing bias value á1.

The developing bias adjustment value â is an adjustment value for adjusting and varying the developing bias for each print sheet; it is preferably set to an optimum value according to the characteristics of the apparatus.

Briefly, when this adjustment value â is set to a small value, the fluctuation in density for each print sheet is diminished. When, conversely, it is set to a large value, the fluctuation in density increases.

On the other hand, when the adjustment value â is set to a small value, the time it takes for the print developing bias á1 to converge to the optimum developing bias á0 increases. When, conversely, it is set to a large value, the requisite time for convergence decreases.

Taking the above reason into consideration, the developing bias adjustment value â is set to 0.5V in this embodiment.

Step 23

The updated bias value á1 is compared with the optimum developing bias á0 calculated through image density control (the value corresponding to the image formation condition after the change).

When á1 is not in excess of á0 yet, the procedure advances to STEP 29, where a developing bias output from a high voltage power source is set to the value of á1.

When á1 has exceeded á0, the procedure advances to STEP 24, where the value of á1 restored to á0 to effect updating.

Step 25, Step 26, Step 27, and Step 28

First, when the developing bias value á1 used in the previous printing is larger than the optimum developing bias á0 calculated through image density control, a computation reverse to that of STEP 21, STEP 22, STEP 23, and STEP 24 is conducted to similarly update the print developing bias value á1.

When none of the conditions of STEP 21 and STEP 25 is satisfied, it means that the print developing bias á1 is equal to the optimum developing bias á0, so that no updating of á1 is effected.

Step 30

Using the print developing bias á1 updated through the above computation, printing is performed.

It goes without saying that the print developing bias value á1 is calculated independently for each of the colors (Y, M, C, and K).

Next, with reference to FIG. 3, the changes in the developing bias and density in this embodiment will be described. FIG. 3 is a graph showing how developing bias and density change with respect to the number of print sheets in the first embodiment of the image forming apparatus of the present invention.

Figure 3A:
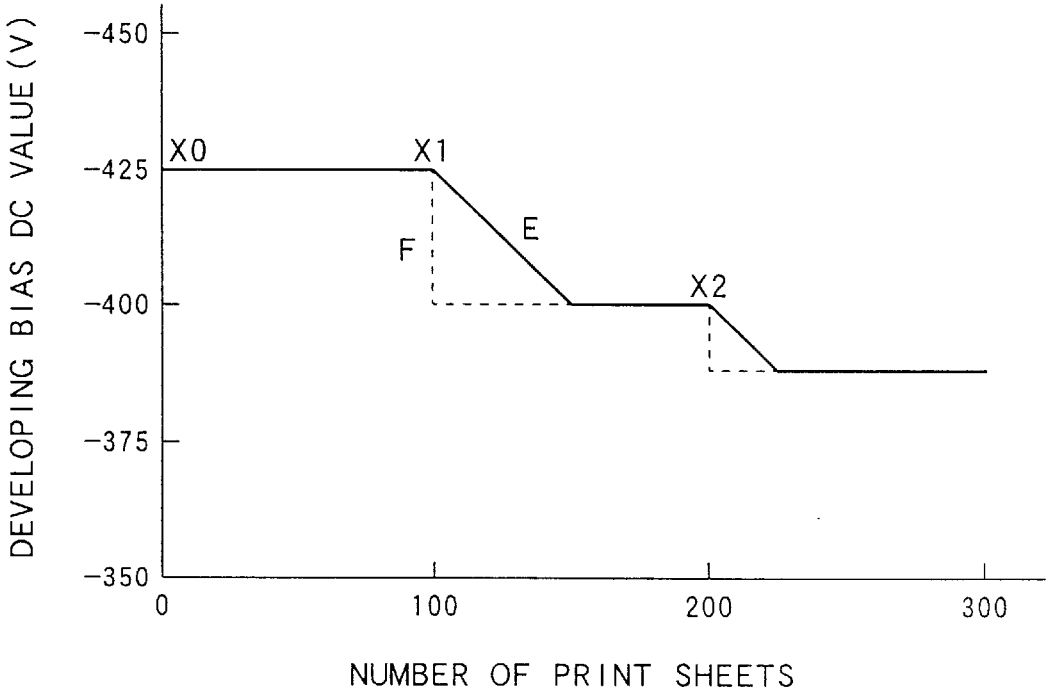
FIGS. 3A and 3B are graphs showing how developing bias and density change with the number of print sheets in the first embodiment of the image forming apparatus of the present invention.
Figure 3B:
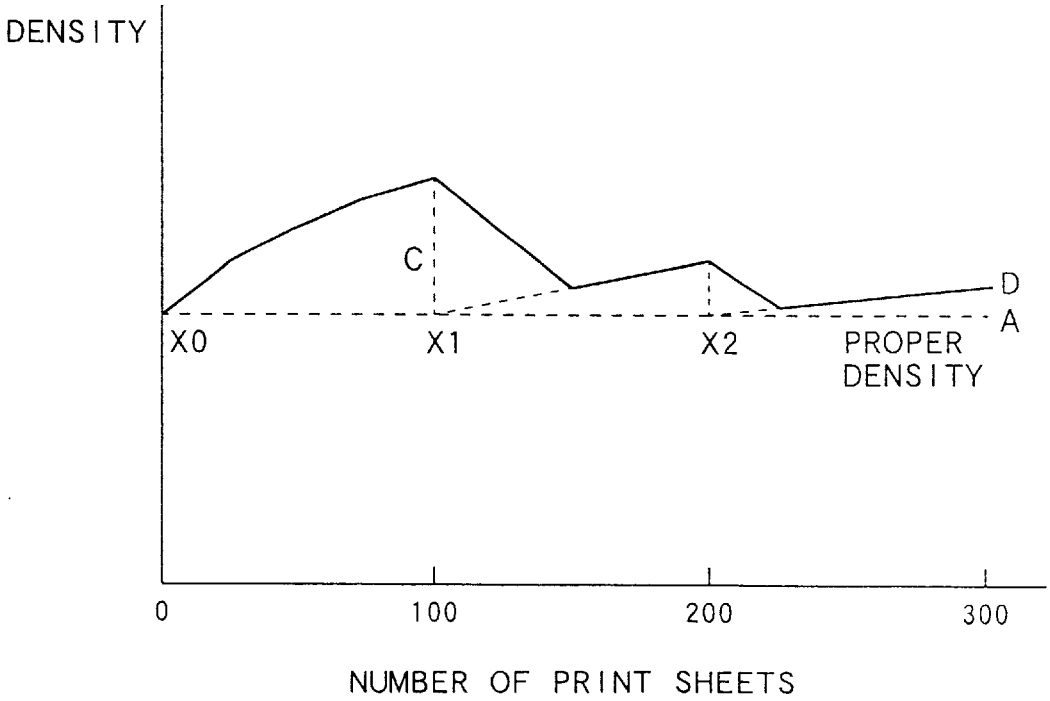

FIG. 3A shows how the developing bias for printing changes, and FIG. 3B shows how the density changes.

In FIG. 3A, the solid line E indicates how the developing bias changes in this embodiment, and the dotted line F indicates how the developing bias changes in the conventional control.

The image density control is executed for 100 print sheets (as indicated by X1 and X2 in the drawings).

In FIG. 3B, the solid line D indicates how the image density changes when this embodiment is adopted, and the dotted line C indicates how the density changes in the conventional control.

In the conventional density control, the print developing bias is updated immediately after the execution of image density control, so that the change in density before and after the control is rather great, whereas in the bias control of this embodiment, no abrupt change in density occurs.

As described above, in this embodiment, the image formation condition is gradually increased or decreased from the first image formation condition which has been selected toward the second image formation condition calculated through image density control, whereby it is possible to prevent an abrupt change in density.

(Second Embodiment)

Next, a second embodiment of the image forming apparatus of the present invention will be described. In accordance with this embodiment, there is provided an image forming apparatus in which a gradual increase or decrease in image formation condition is effected from a first image formation condition selected immediately before the execution of image density control toward a second image formation condition calculated through image density control at a rate of change corresponding to the difference between the first image formation condition and the second image formation condition, whereby an abrupt change in density is prevented, and the image density is prevented from being greatly deviated from a proper density for a long period of time.

The general construction of this embodiment and the devices with which it is equipped are the same as those of the prior-art technique described with reference to FIGS. 8 and 9, so that a detailed description thereof will be omitted, and FIGS. 8 and 9 will be referred to as appropriate.

In this embodiment also, the DC component of the developing bias is used as the image formation condition to be changed for image density control.

Figure 4:
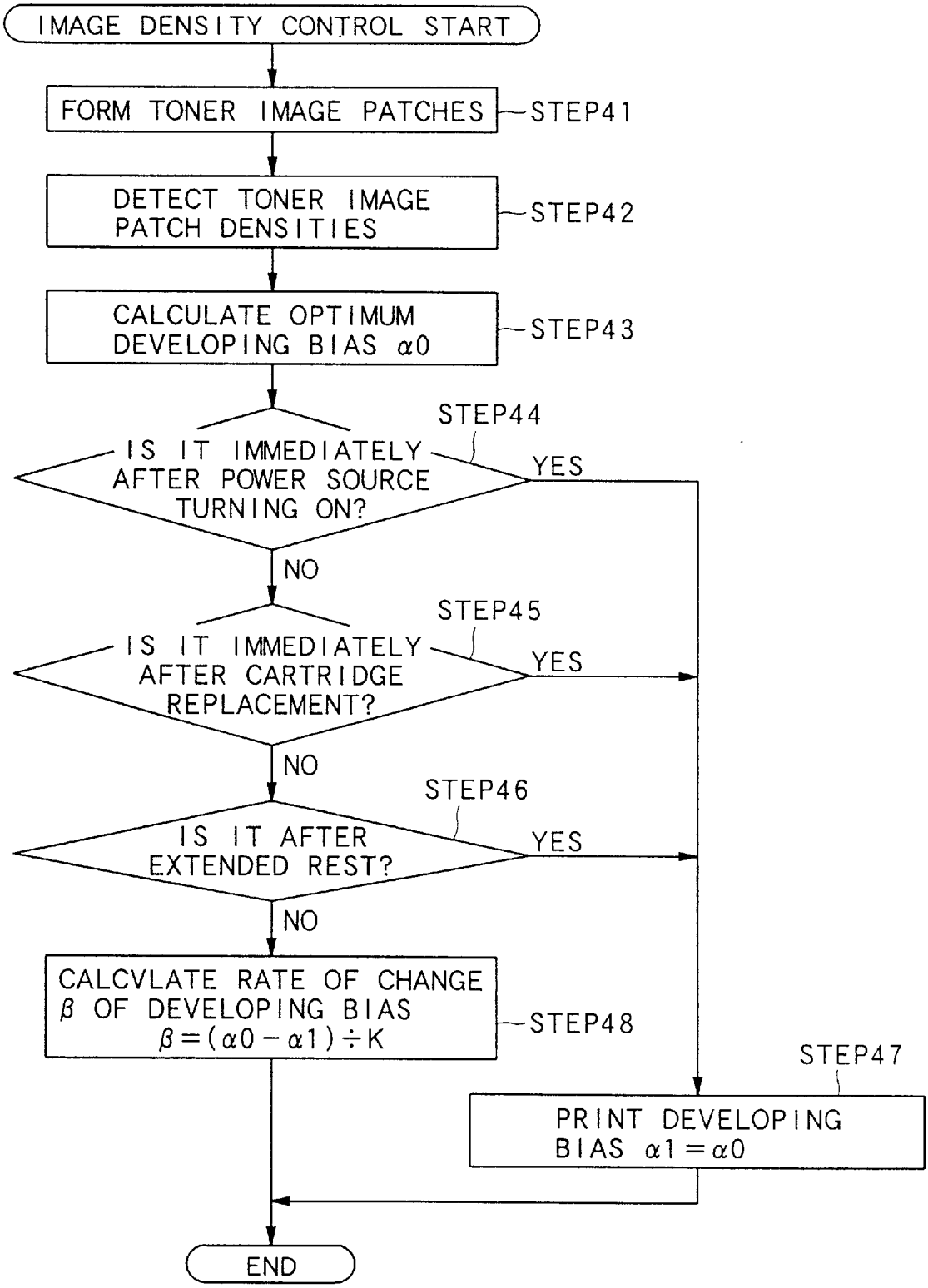
FIG. 4 is a flowchart showing an image forming operation applicable to a second embodiment of the image forming apparatus of the present invention.

First, with reference to the flowchart of FIG. 4, the image density control of this embodiment will be described in detail. FIG. 4 is a flowchart illustrating an image forming operation applicable to the second embodiment of the image forming apparatus of the present invention.

First, when an image density control execution command is input to the CPU 17 of the main body, an image density control sequence is started.

Step 41, Step 42, and Step 43

Toner images for detection (toner patches) are formed on the photosensitive drum 1, and the densities of the toner patches are measured by the density sensor 9.

Further, from the result of the measurement of the toner patch densities, the optimum developing DC voltage (optimum developing bias) á0 which is a value in correspondence with the second image formation condition is calculated.

The above method is similar to that of the first embodiment, so that a detailed description thereof will be omitted.

Step 44, Step 45, and Step 46

A judgment is made as to whether image density control is to be executed when the main body power source is ON (STEP 44).

Similarly, a judgment is made as to whether image density control is to be executed immediately after the replacement of the cartridge (process cartridge A or the developing cartridge) (STEP 45).

Further, a judgment is made as to whether image density control is to be executed or not when a print command is received when the apparatus has not been used for a long period of time (one hour in this embodiment (STEP 46).

In any case, it is desirable to use the optimum developing bias value á0 calculated immediately after the density control, so that the procedure advances to STEP 47, where the optimum developing bias á0 obtained through image density control is input to the print developing bias value á1.

Step 48

When none of the conditions of STEP 44, STEP 45, and STEP 46 applies, the image density control executed is that which is to be conducted when printing has been performed on a predetermined number of sheets (100 sheets in this embodiment).

In this case, variation is effected while gradually increasing or decreasing the developing bias from immediately after the image density control, calculating the rate of change a of the developing bias used at this time.

In this embodiment, the rate of change a of the developing bias is calculated by the following equation:

$$\text{Rate of change } \hat{a} \text{ of developing bias} = (\text{optimum developing bias } \hat{a}0 - \text{developing bias } \hat{a}1 \text{ immediately before density control} \div K$$

(where K is a predetermined constant)

That is, in this calculation, the rate of change a of the developing bias is determined according to the difference between the optimum developing bias á0 (the control value corresponding to the second image formation condition) and the developing bias á1 immediately before density control (the control value corresponding to the first image formation condition), so that regardless of the magnitude of the difference, the developing bias used becomes equal to the optimum developing bias when printing is performed on a fixed number of sheets (represented by K in the above equation). That is, when the developing bias for density control achieves the level of K, the developing bias is changed to the optimum developing bias.

However, even when the difference is large, it is possible to prevent the image density from being greatly deviated from the proper density for a long period of time.

It is desirable that the predetermined constant K be set to an optimum value according to the characteristics of the apparatus.

Briefly, when this constant K is set to a large value, the fluctuation in density each time printing is performed is small. Conversely, when it is set to a small value, the fluctuation in density is large.

On the other hand, when the constant K is set to a large value, the time it takes for the print developing bias á1 to converge to the optimum developing bias á0 increases. Conversely, when it is set to a small value, the convergence time decreases. Taking this into consideration, the value of the predetermined constant K is set to 25 in this embodiment.

The above image density control is conducted for each of the colors, Y, M, C, and K to complete the image density control.

It goes without saying that the optimum developing bias value á0, the print developing bias value á1, and the rate of change â of the developing bias are independently provided for each of the colors (Y, M, C, and K) and are separately stored in the main body memory.

The control of the developing bias at the time of printing is the same as that in the first embodiment (FIG. 2).

Figure 5A:
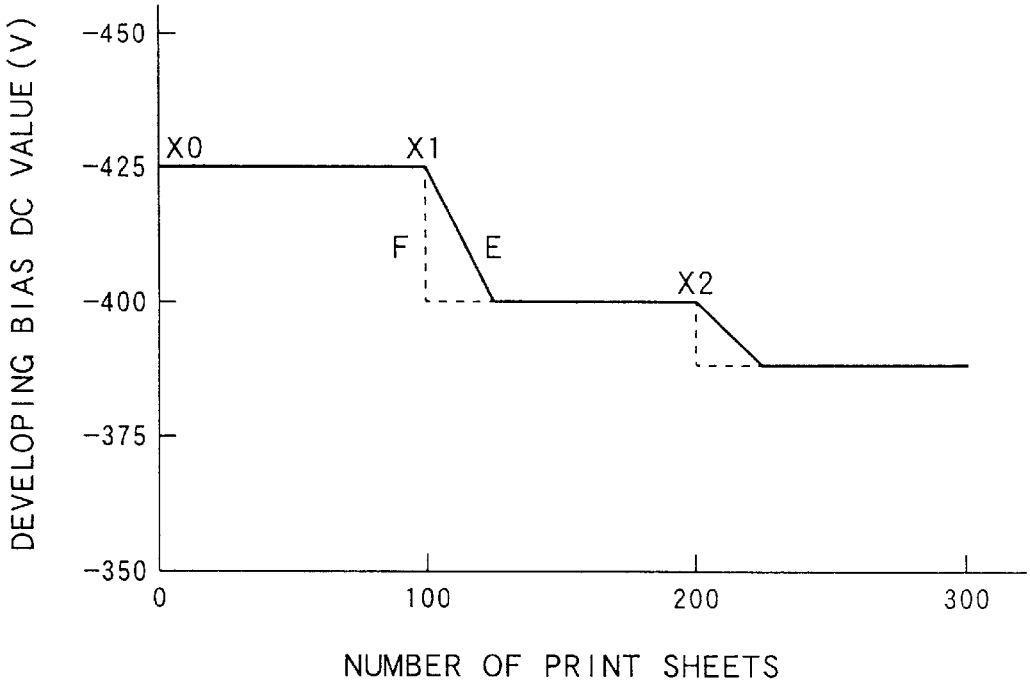
FIGS. 5A and 5B are graphs showing how developing bias and density change with the number of print sheets in the second embodiment of the image forming apparatus of the present invention.
Figure 5B:
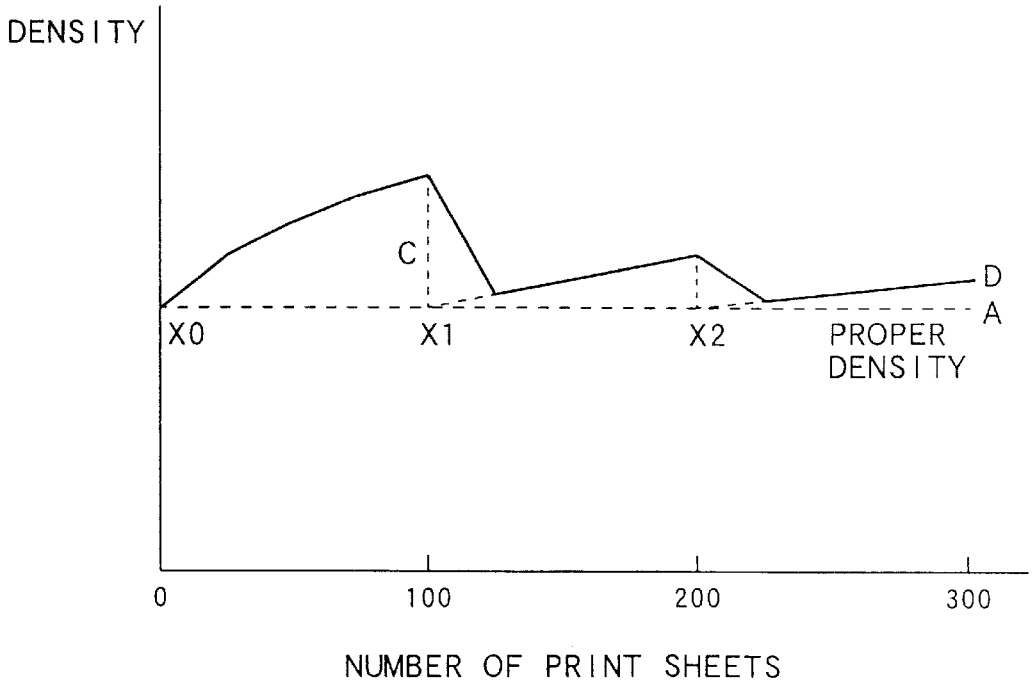

Next, the changes in the developing bias and the density in this embodiment will be described with reference to FIGS. 5A and 5B. FIGS. 5A and 5B are graphs showing how the developing bias and the density change with respect to the number of print sheets in the second embodiment of the image forming apparatus of the present invention.

FIG. 5A illustrates how the developing bias for printing changes, and FIG. 5B illustrates how the density changes.

In FIG. 5A, the solid line E indicates the change of the developing bias in this embodiment, and the dotted line F indicates the change of the developing bias in the conventional control.

The image density control is executed each time printing has been performed on 100 sheets (as indicated by X0, X1, and X2 in the drawings).

Further, in FIG. 5B, the solid line D indicates the change of the image density when this embodiment is adopted, and the dotted line C indicates the density change in the case of a conventional control.

In the conventional density control, the print developing bias is updated immediately after the execution of image density control, so that the density change is very remarkable before and after the control, whereas, when the bias control of this embodiment is adopted, no abrupt change in density is caused.

Further, the rate of change of the developing bias is varied according to the difference between the optimum developing bias and the developing bias immediately before density control, so that, even when the difference is large, it is possible to prevent the image density from being greatly deviated from the proper density for a long period of time (At point X1 in the drawing, the value of the solid line D is not greatly deviated from the proper density A for a long period of time).

As described above, in this embodiment, the image formation condition is gradually increased or decreased from the first image formation condition selected immediately before the execution of image density control toward the second image formation condition calculated through image density control at a rate of change in correspondence with the difference between the first image formation condition and the second image formation condition, whereby an abrupt change in density is prevented, and it is possible to prevent the image density from being greatly deviated from the proper density for a long period of time.

(Third Embodiment)

Next, a third embodiment of the image forming apparatus of the present invention will be described. In this embodiment, when the difference between a first image formation condition selected immediately before the execution of image density control and a second image formation condition calculated through image density control is smaller than a predetermined value, the second image formation condition is used from immediately after the execution of the image density control. Otherwise, the image formation condition is gradually increased or decreased from the first image formation condition selected immediately before the execution of image density control toward the second image formation condition calculated through image density control, whereby an abrupt change in density is prevented, and it is possible to prevent the image density from being greatly deviated from the proper density for a long period of time.

In this embodiment also, the DC component of the developing bias is used as the image formation condition to be varied so as to control the image density.

Further, the general construction of the image forming apparatus of the present invention and the device with which it is equipped are the same as those of the conventional technique described above with reference to FIGS. 8 and 9, so a detailed description thereof will be omitted, and FIGS. 8 and 9 will be referred to as appropriate.

Figure 6:
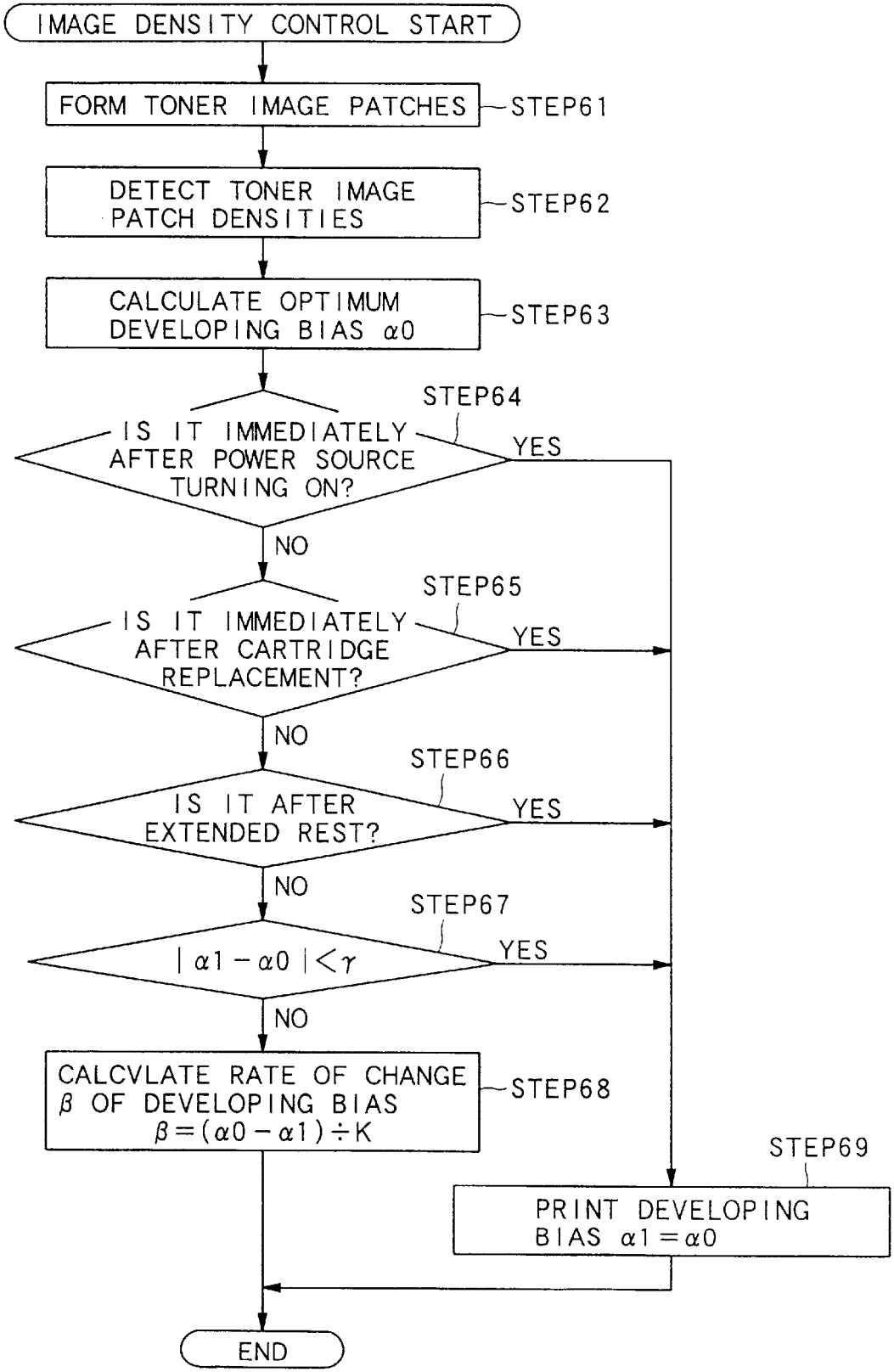
FIG. 6 is a flowchart showing an image forming operation applicable to a third embodiment of the image forming apparatus of the present invention.

First, with reference to the flowchart of FIG. 6, the image density control of this embodiment will be described in detail. FIG. 6 is a flowchart illustrating an image forming operation applicable to the third embodiment of the image forming apparatus of the present invention.

First, when an execution command for image density control is input to the CPU 17 of the main body, an image density control sequence is started.

Step 61, Step 62, and Step 63

Toner images for detection (toner patches) are formed on the photosensitive drum 1, and the densities of the toner patches are measured by the density sensor 9. Further, from the results of the measurement of the toner patch densities, an optimum developing DC voltage (optimum developing bias) á0 is calculated. The above-described method is the same as that of the first embodiment, so a detailed description thereof will be omitted.

Step 64, Step 65, and Step 66

Next, a judgment is made as to whether image density control is to be executed when the main body power source is ON (STEP 64).

Similarly, a judgment is made as to whether or not image density control is to be executed immediately after the replacement of the cartridge (process cartridge A or the development cartridge) (STEP 65).

Further, a judgment is made as to whether or not image density control is to be executed when a print command is received when the apparatus has not been used for a long period of time (one hour in this embodiment) (STEP 66).

In any case, it is desirable to use the value of the optimum developing bias á0 calculated immediately after the density control, so that the procedure advances to STEP 69, where the optimum developing bias á0 obtained through image density control is input to the print developing bias value á1.

When none of the conditions of STEP 64, STEP 65, and STEP 66 applies, the image density control is executed when printing has been performed on a predetermined number of sheets (100 sheets in this embodiment).

Step 67

Next, a judgment is made as to whether the difference between the optimum developing bias á0 (control value corresponding to the second image formation condition) calculated through image density control and the developing bias á1 used immediately before the density control (control value corresponding to the first image formation condition) is smaller than a predetermined value ã.

When the difference is smaller than the predetermined value, the difference in density before and after the control is not so great even if the optimum developing bias á0 is used from immediately after the density control.

Thus, in this case, by using the optimum developing bias value á0 calculated immediately after the density control, control is performed such that the proper density can be achieved immediately (The procedure advances to STEP 69).

It is desirable for the predetermined constant ã to be set to an optimum value according to the characteristics of the apparatus. Specifically, it is desirable for the value of ã to be set such that the density fluctuation when the developing bias is varied by ã is equal to the maximum value of the density fluctuation permissible to the user. Taking the above into consideration, the predetermined difference value ã is set to 20V in this embodiment.

Step 68

The rate of change â of the developing bias used when varying the developing bias while gradually increasing or decreasing it is calculated. The method of calculating the rate of change ã of the developing bias is the same as that in the second embodiment. Of course, the value used when varying the developing bias while gradually increasing or decreasing may be a predetermined value as in the first embodiment described above.

The above image density control is performed for each of the colors Y, M, C, and K to complete the image density control.

The developing bias control at the time of printing is the same as that in the first embodiment described above (FIG. 2).

Figure 7A:
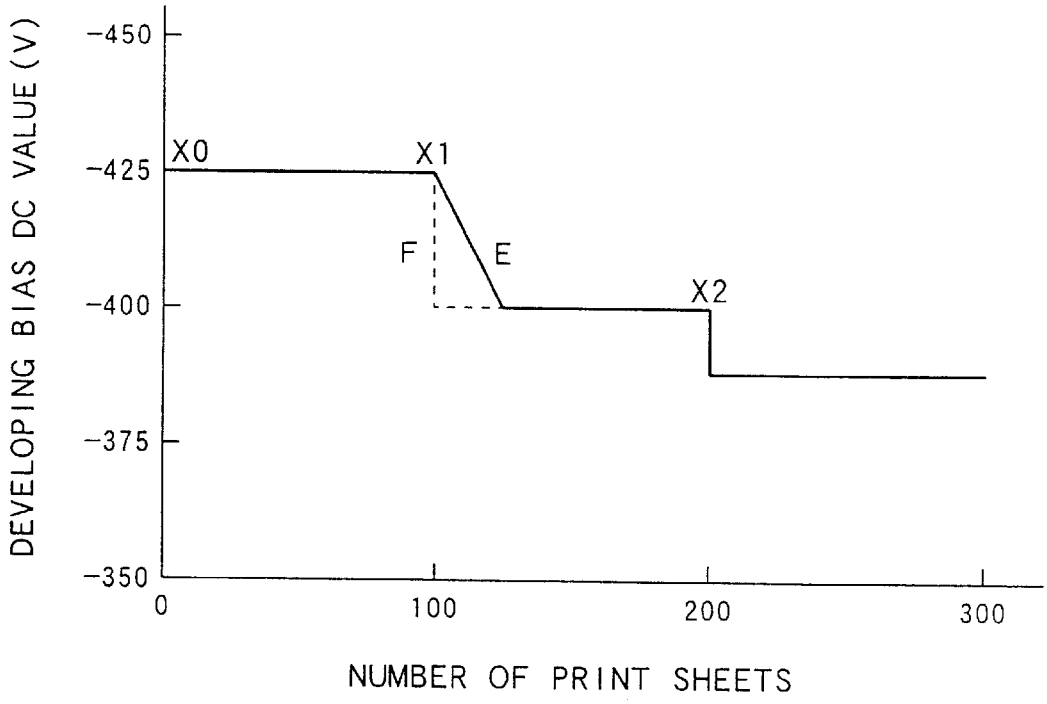
FIGS. 7A and 7B are graphs showing how developing bias and density change with the number of print sheets in the third embodiment of the image forming apparatus of the present invention.
Figure 7B:
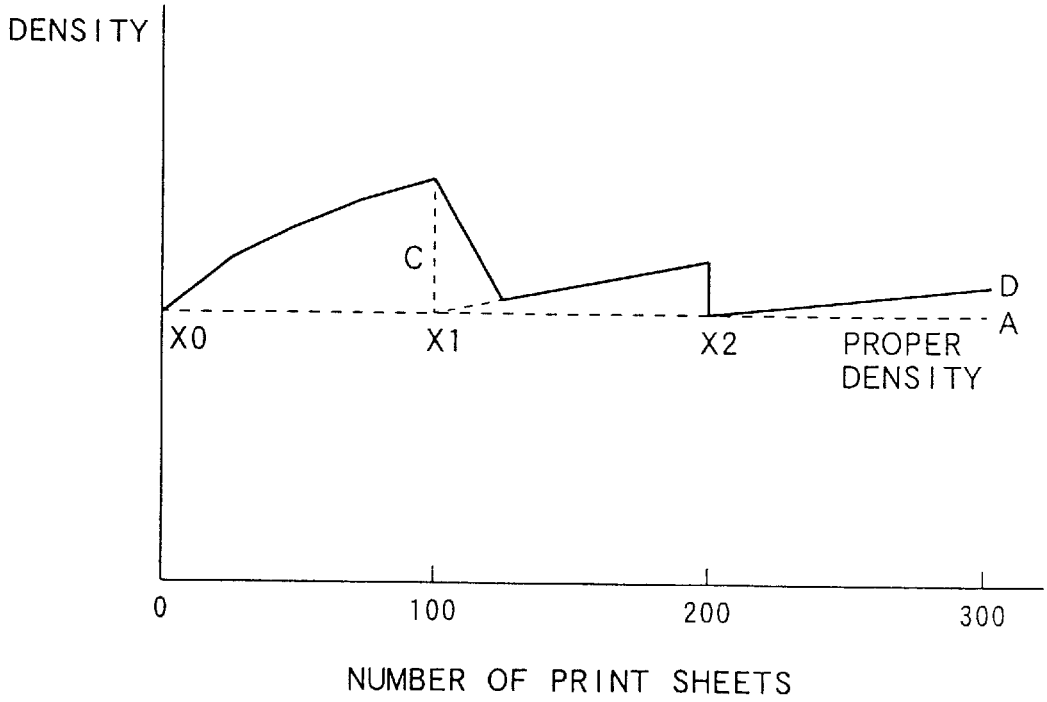

Next, the way the developing bias and the density chance will be described with reference to FIGS. 7A and 7B. FIGS. 7A and 7B are graphs showing how the developing bias and the density change with respect to the number of print sheets in the third embodiment of the image forming apparatus of the present invention.

FIG. 7A shows the way the developing bias for printing changes, and FIG. 7B shows the way the density changes.

In FIG. 7A, the solid line E indicates the change in the developing bias in this embodiment, and the dotted line F indicates the change in the developing bias in the conventional control.

Image density control is executed each time printing has been performed on 100 sheets (as indicated by points X0, X1, and X2 in the drawing).

In FIG. 7B, the solid line D indicates the change in the image density when this embodiment is applied, and the dotted line C indicates the change in the density in the conventional control.

In the bias control of this embodiment, when the difference between the optimum developing bias calculated through density control and the developing bias immediately before the density control is large, the developing bias is gradually varied from after the execution of the density control, so that no abrupt change in density is caused (at point X1 in the drawing).

Further, when the difference between the optimum developing bias calculated through density control and developing bias immediately before the density control is small, it is possible to quickly achieve the optimum density by using the optimum developing bias from immediately after the execution of the density control.

In this case, there is no fear that the difference in density will become too large before and after the execution of the density control (point X2 in the drawing).

That is, by adopting this embodiment, it is possible to perform control so as to bring the image density closer to the proper density while preventing an extreme variation in density.

As described above, in this embodiment, when the difference between the first image formation condition selected immediately before the execution of image density control and the second image formation condition calculated through image density control is smaller than a predetermined value, the second image formation condition is used from immediately after the execution of the image density control. Otherwise, the image formation condition is gradually increased or decreased from the first image formation condition selected immediately before the execution of the image density control toward the second image formation condition calculated through image density control, whereby an abrupt change in density is prevented, and it is possible to prevent the image density from being greatly deviated from the proper density for a long period of time.

While in the above-described embodiments of the image forming apparatus of the present invention only the developing bias is used as the image formation condition for the image density control, it goes without saying that it is also possible to use other image formation conditions, such as charging condition or exposure condition (exposure amount), or arbitrarily combine them for control.

In a conventionally well-known method, an optimum image formation condition is calculated for each print from the condition of use of the photosensitive drum or the developing device, the use environment of the apparatus detected by an environment sensor, etc., and is varied.

The above method, in which image density control is executed for each print, is different from the present invention.

As described above, the image formation condition is gradually increased or decreased from the first image formation condition selected immediately before the execution of image density control toward the second image formation condition calculated through image density control, whereby it is possible to prevent an abrupt change in density.

Further, by gradually increasing or decreasing the image formation condition at a rate of change in correspondence with the difference between the first image formation condition and the second image formation condition, an abrupt change in density is prevented, and it is possible to prevent the image density from being greatly deviated from the proper density for a long period of time.

Further, when the difference between the first image formation condition and the second image formation condition is small, the second image formation condition is used from immediately after the execution of the image density control, whereby it is possible to quickly achieve the proper density.

The above-described embodiments of the present invention should not be construed restrictively. All manner of modifications are possible without departing from the scope of the present invention.

What is claimed is:

1. An image forming apparatus comprising:

an image forming means for forming an image on a recording material;

a detecting means for detecting an image density; and a changing means for changing a former image formation condition for the image forming means to a next image formation condition for the image forming means on the basis of a detection result of the detecting means, wherein the changing means is capable of changing the former image formation condition so as to bring it close to the next image formation condition through a stepwise change of image formation condition.

2. An image forming apparatus according to claim 1, wherein when a first value corresponding to the next image formation condition is smaller than a second value corresponding to the former image formation condition, subtraction of a predetermined value is performed on the second value to thereby determine the stepwise change of image formation condition, and wherein when the first value corresponding to the next image formation condition is larger than the second value corresponding to the former image formation condition, a predetermined value is added to the second value to thereby determine the stepwise change of image formation condition.

3. An image forming apparatus according to claim 1, wherein when a first value corresponding to the next image formation condition is smaller than a second value corresponding to the former image formation condition, subtraction is performed in accordance with a rate of change of the second value and the first value to thereby determine the stepwise change of image formation condition, and wherein when the first value corresponding to the next image formation condition is larger than the second value corresponding to the former image formation condition, addition is performed in accordance with the rate of change to thereby determine the stepwise change of image formation condition.

4. An image forming apparatus according to claim 1, wherein the stepwise change of image formation condition is effected each time image forming operation is performed by the image forming means.

5. An image forming apparatus according to claim 2 or 3, wherein when the subtraction results in a value not larger than the first value, or when the addition results in a value not smaller than the first value, an image formation condition corresponding to the first value is used.

6. An image forming apparatus according to claim 1, wherein when a difference between the former image formation condition and the next image formation condition is within a predetermined range, the former image formation condition is set without performing the stepwise change of image formation condition.

7. An image forming apparatus according to claim 1, wherein when, after a power source of the apparatus is turned on, the image density is detected by the detecting means before the image formation by the image forming means is started, the first image formation condition of the image forming means is set without performing the stepwise change of image formation condition.

8. An image forming apparatus according to claim 1, wherein when the image density is detected by the image detecting means after a predetermined period of time when the apparatus has not been used, the first image formation condition of the image forming means is set without performing the stepwise charge of image formation condition.

9. An image forming apparatus according to claim 1, wherein the apparatus has a process cartridge detachable with respect to a main body of the apparatus, wherein the process cartridge is equipped with an image bearing member and a charging means for charging the image bearing member, and wherein when the image density is detected by the detecting means after the process cartridge is replaced, the first image formation condition of the image forming means is set without performing the stepwise change of image formation condition.

10. An image forming apparatus according to claim 1, wherein the image forming means includes an image bearing member, a toner image forming means for forming a toner image on the image bearing member, and a transfer means for transferring the toner image to the recording material.

11. An image forming apparatus according to claim 10, wherein the image formation condition is a toner image formation condition for the toner image forming means.

12. An image forming apparatus according to claim 11, wherein the toner image forming means is equipped with an electrostatic image forming means for forming an electrostatic image on the image bearing member and a developing means for developing the electrostatic image with toner, and wherein the image formation condition is at least one of an electrostatic image formation condition for the electrostatic image forming means and a development condition for the developing means.

13. An image forming apparatus according to claim 12, wherein the development condition is a DC voltage applied to the developing means.

14. An image forming apparatus according to claim 12, wherein the image bearing member is a photosensitive member, wherein the electrostatic image forming means is equipped with a charging means for charging the photosensitive member and an exposure means for subjecting the photosensitive member charged by the charging means to exposure, and wherein the electrostatic image formation condition is at least one of a charging condition for the charging means and an exposure condition for the exposure means.

15. An image forming apparatus according to claim 1, wherein the detecting means detects the image density each time the image forming means has formed a predetermined number of images.

16. An image forming apparatus according to claim 1, wherein the detecting means is a detection sensor for detecting the density of a toner image.

17. An image forming apparatus according to claim 16, wherein the detection sensor is equipped with a light emitting portion for applying light to the toner image and a light receiving portion for receiving light applied to the toner image.

18. An image forming apparatus according to claim 1, wherein the image forming means is capable of forming a color image on the recording material.

* * * * *

UNITED STATES PATENT AND TRADEMARK OFFICE

CERTIFICATE OF CORRECTION

PATENT NO. : 6,505,012 B2
DATED : January 7, 2003
INVENTOR(S) : Yoichiro Maebashi et al.

It is certified that error appears in the above-identified patent and that said Letters Patent is hereby corrected as shown below:

Drawings,
Sheet 4, FIG. 4, "CALCVLATE RATE OF CHANGE" should read
-- CALCULATE RATE OF CHANGE --; and
Sheet 6, FIG. 6, "CALCVLATE RATE OF CHANGE" should read
-- CALCULATE RATE OF CHANGE --.

Column 3,
Line 36, "Interior" should read -- interior --.

Figure 8:
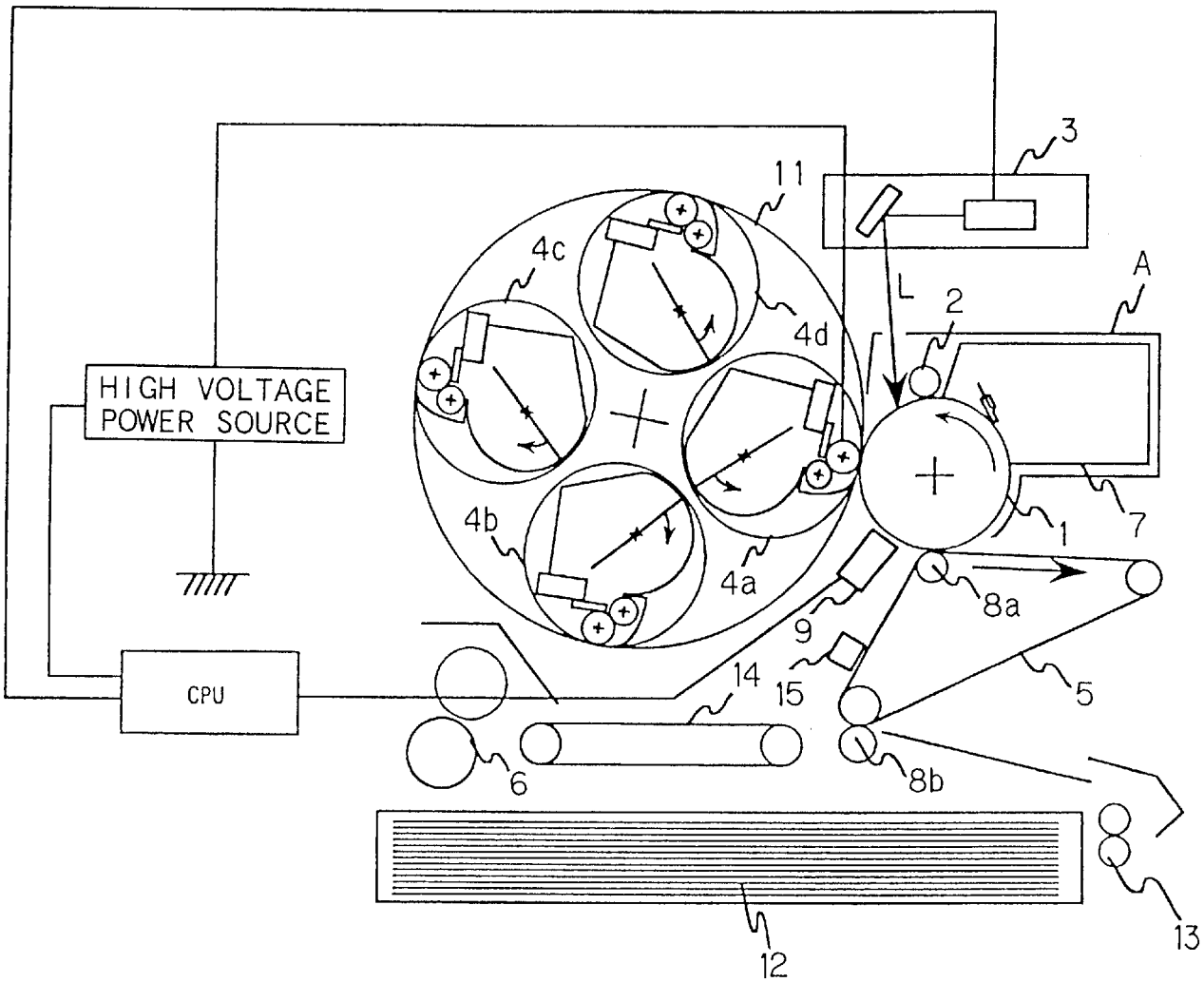
FIG. 8 PRIOR ART
FIG. 8 is a sectional view of a conventional color image forming apparatus.
Figure 9:
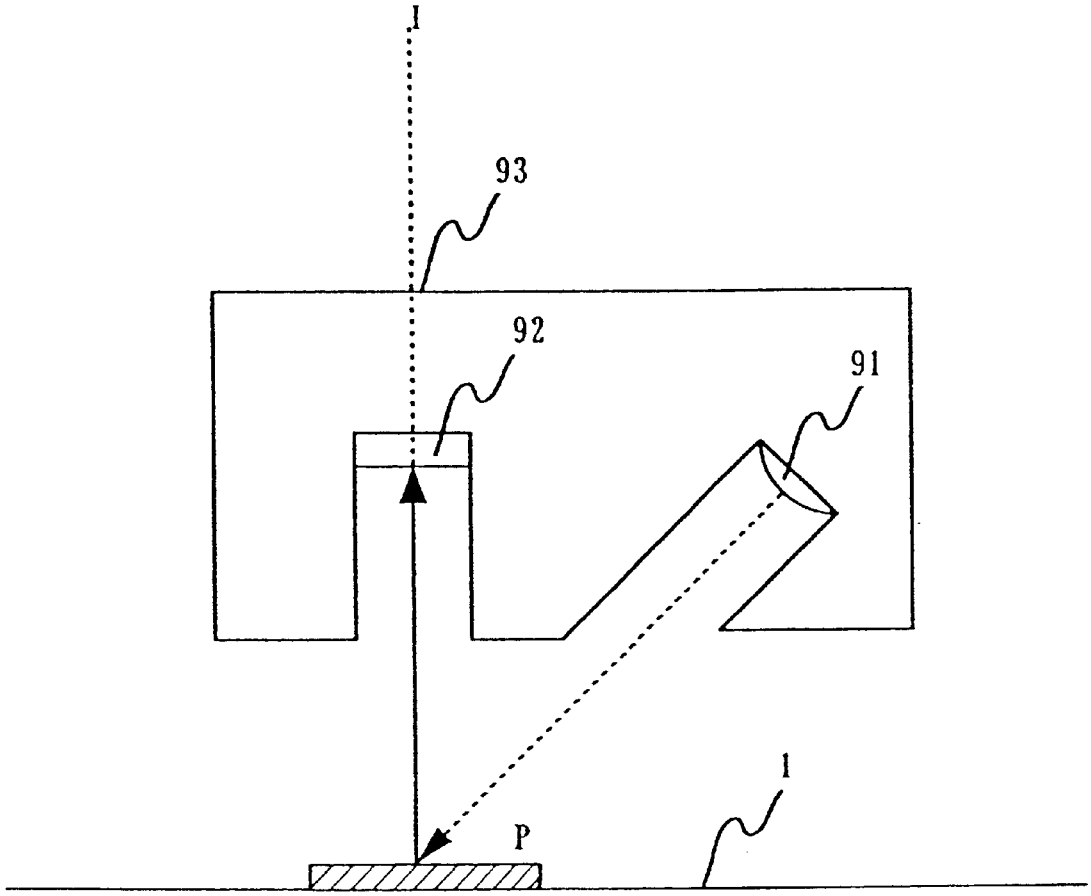
FIG. 9 PRIOR ART
FIG. 9 is a schematic view of a density sensor applicable to the image forming apparatus shown in FIG. 8.
Figure 10:
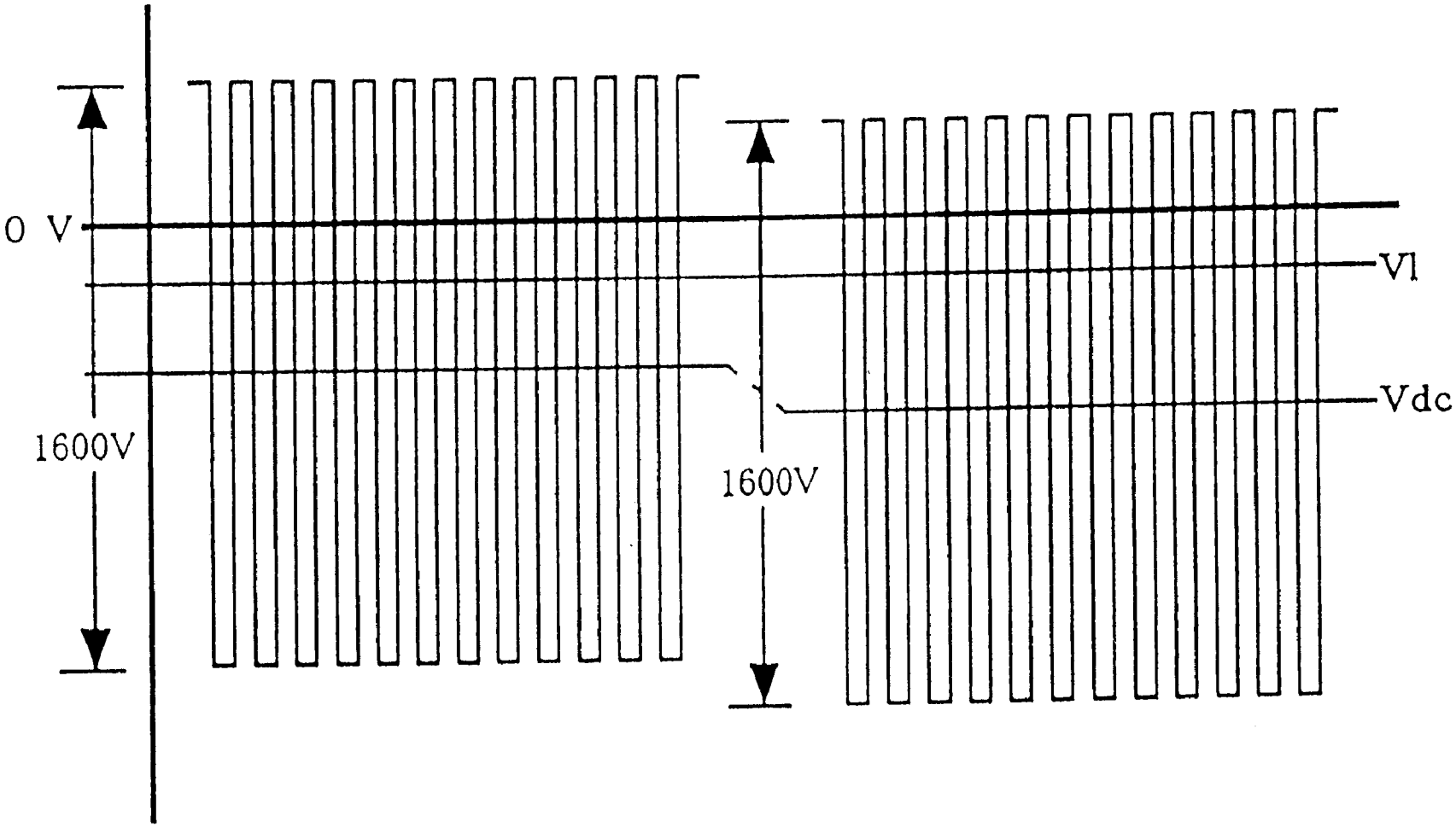
FIG. 10 PRIOR ART
FIG. 10 is a graph showing a developing bias applicable to the image forming apparatus shown in FIG. 6.
Figure 11:
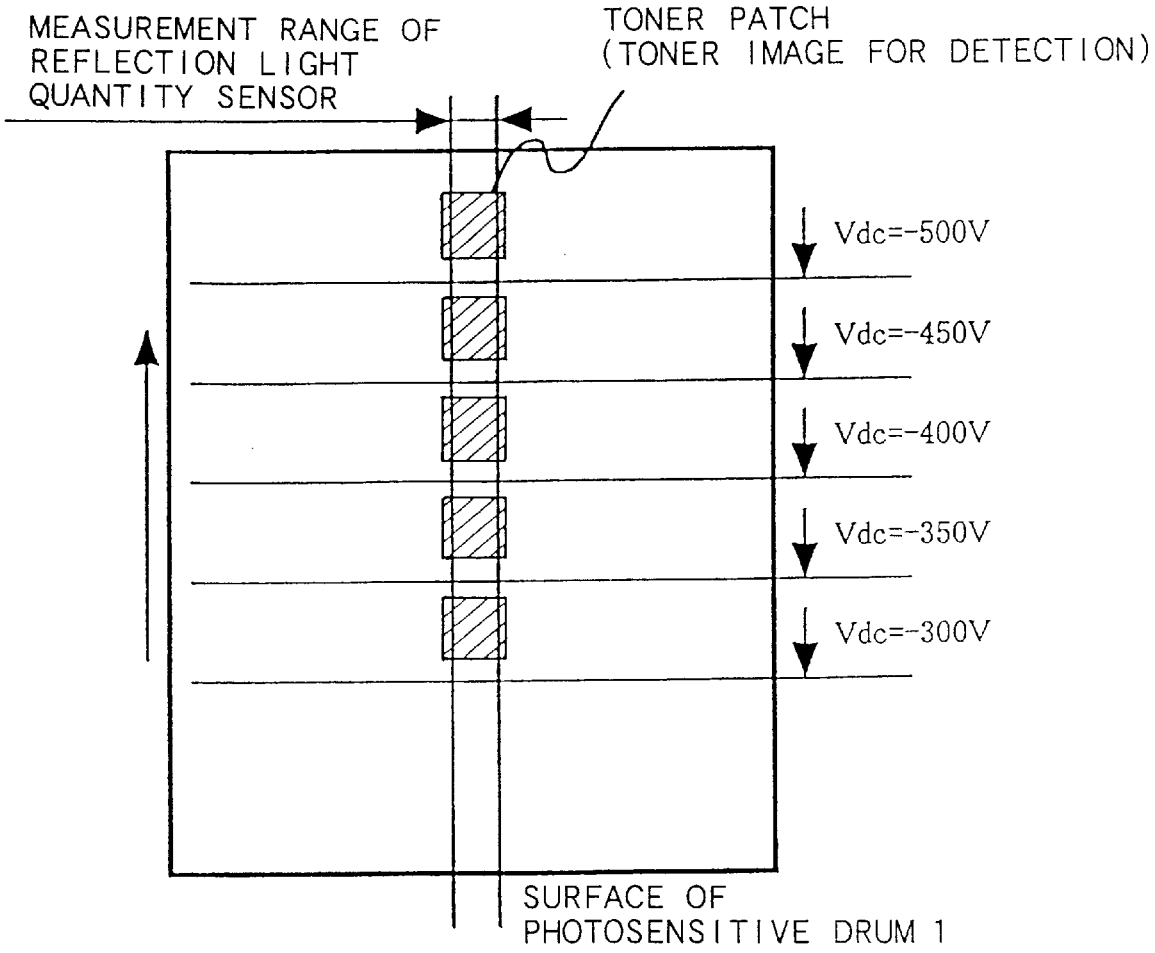
FIG.11 PRIOR ART
FIG. 11 is a schematic view of density detection patches applicable to the image forming apparatus shown in FIG. 8.
Figure 12:
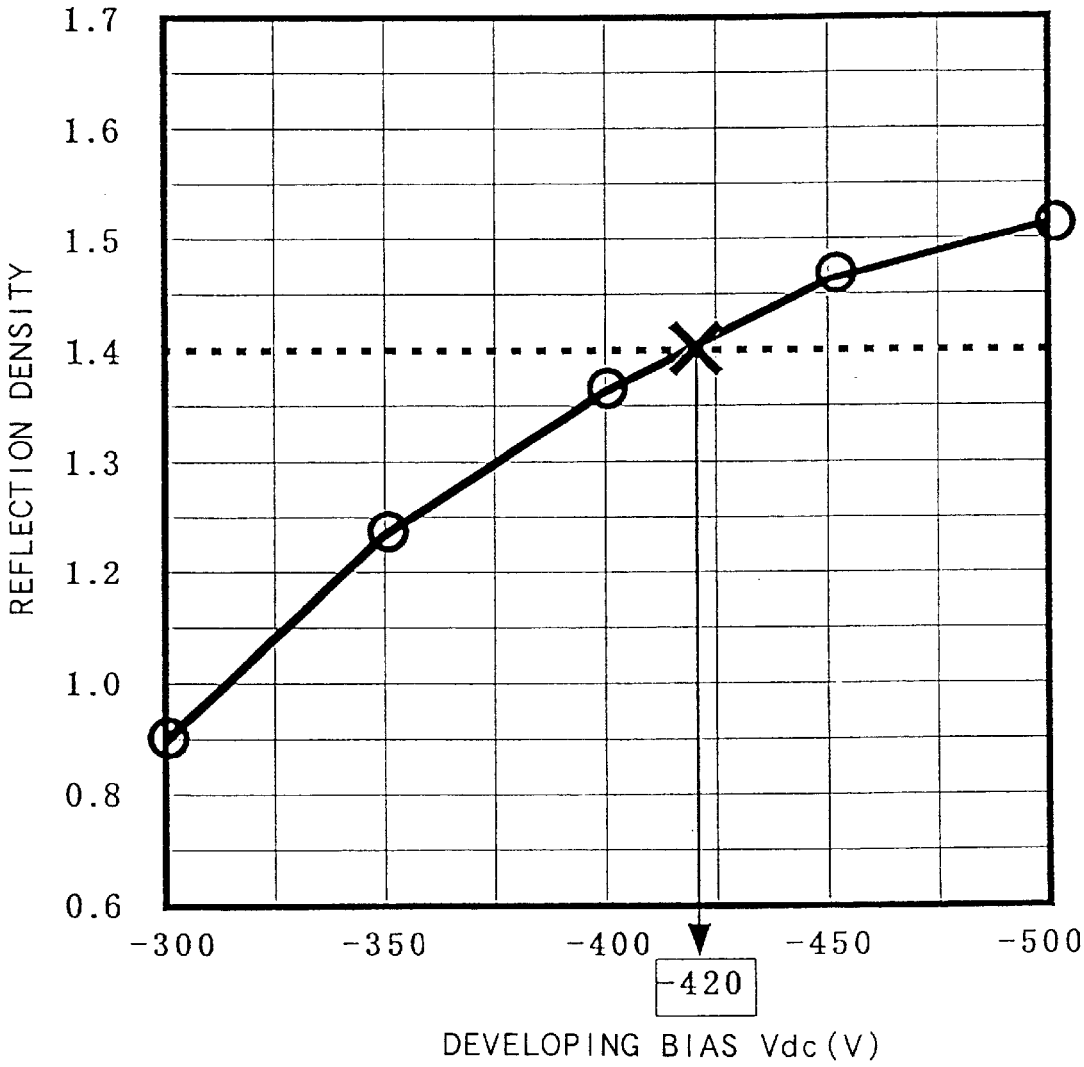
FIG. 12 PRIOR ART
FIG. 12 is a graph showing the relationship between reflection density and developing bias in the image forming apparatus shown in FIG. 8.
Figure 13:
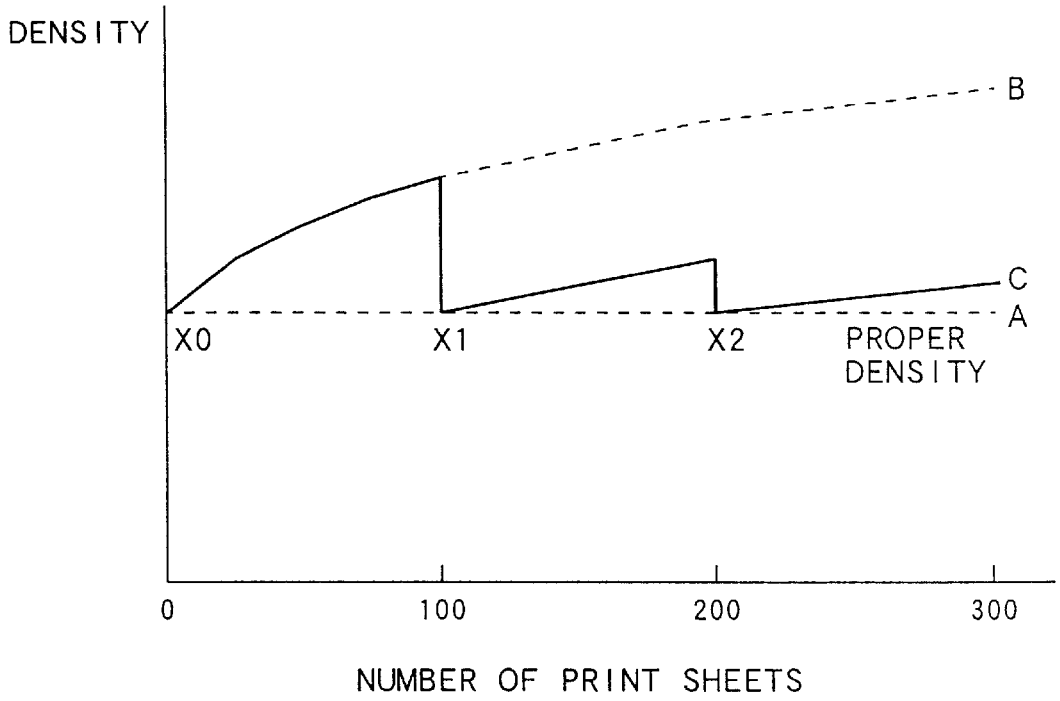
FIG. 13 PRIOR ART
FIG. 13 is a graph showing how image density changes when printing is successively executed in a conventional image forming apparatus.
Figure 14:
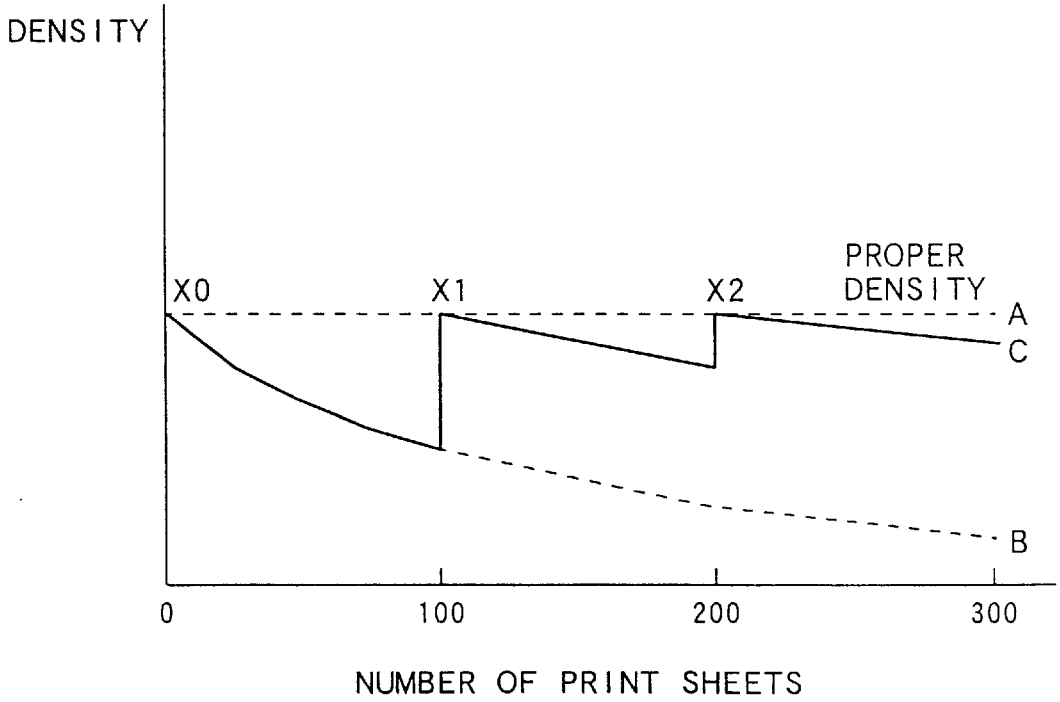
FIG. 14 PRIOR ART
FIG. 14 is a graph showing how image density changes when printing is successively executed in a conventional image forming apparatus.

Column 6,
Line 10, "FIG. 6;" should read -- FIG. 8; --.

Column 7,
Line 3, "source s" should read -- source is --.

Column 10,
Line 37, "(STEP 46)." should read -- (STEP 46)). --;
Lines 52 and 53, "a" should read -- â --.

Column 13,
Line 47, "chance" should read -- change --.

Signed and Sealed this

Ninth Day of September, 2003

JAMES E. ROGAN
*Director of the United States Patent and Trademark Office*